US005951396A

United States Patent [19]

Tawil

[11] Patent Number: 5,951,396

[45] Date of Patent: Sep. 14, 1999

[54] APPARATUS AND METHOD FOR REAL TIME MONITORING AND REGISTERING OF BINGO GAME

[75] Inventor: Saleem Tawil, Austin, Tex.

[73] Assignee: Diversified Communication Engineering, Inc., Austin, Tex.

[21] Appl. No.: 08/815,433

[22] Filed: Mar. 11, 1997

[51] Int. Cl.[6] ..... A63F 9/24

[52] U.S. Cl. ..... 463/19; 273/269

[58] Field of Search ..... 463/19, 18, 17, 463/16; 273/269

[56] References Cited

U.S. PATENT DOCUMENTS

| | | | |
|---|---|---|---|
| 4,373,726 | 2/1983 | Churchill et al. | 463/18 |
| 4,378,940 | 4/1983 | Gluz et al. | 273/269 |
| 4,455,025 | 6/1984 | Itkis | 273/269 |
| 4,475,157 | 10/1984 | Bolan | 364/410 |
| 4,798,387 | 1/1989 | Richardson | 273/237 |
| 4,848,771 | 7/1989 | Richardson | 273/237 |
| 4,909,516 | 3/1990 | Kolinsky | 273/237 |
| 5,054,787 | 10/1991 | Richardson | 273/369 |
| 5,072,381 | 12/1991 | Richardson et al. | 364/410 |
| 5,096,202 | 3/1992 | Hesland | 273/237 |
| 5,230,514 | 7/1993 | Frain | 273/237 |
| 5,351,970 | 10/1994 | Fioretti | 463/19 |
| 5,494,294 | 2/1996 | Cappetta | 273/269 |
| 5,518,253 | 5/1996 | Pocock et al. | 463/19 |
| 5,577,727 | 11/1996 | Brame et al. | 273/139 |
| 5,687,971 | 11/1997 | Khaladkar | 273/269 |

*Primary Examiner*—Michael O'Neill
*Attorney, Agent, or Firm*—Russell D. Culbertson; Shaffer & Culbertson, LLP

[57] ABSTRACT

An apparatus (10) for monitoring and registering a bingo game includes an arrangement for entering and storing a game card identifier (32) associated with each game card (30) issued in a game sequence. The apparatus (10) also includes storage (16) for storing the card pattern of each card issued in the game sequence, along with all of the symbols drawn by a game operator during the game sequence. A winning pattern comparing arrangement is connected to the card pattern and drawn symbol storage (16) and operates to compare the potential winning symbol patterns of each card issued in the game sequence with each drawn symbol immediately after the symbol is drawn. The comparison is to determine each match between the drawn symbol and a card symbol and discover the winning card in the game sequence. The apparatus (10) further includes a display for displaying the card identifier of the winning card or cards to the game operator and players.

16 Claims, 4 Drawing Sheets

Figure 4

50

GAME WINS4 TABLE

| GAME CARD NO. | VECTOR NO. | TOTAL MATCHES | REQUIRED NUMBERS | | | |
|---|---|---|---|---|---|---|
| 1 | 1 | 0 | 3 | 26 | 47 | 70 |
| 1 | 2 | 0 | 72 | 51 | 18 | 8 |

APPARATUS AND METHOD FOR REAL TIME MONITORING AND REGISTERING OF BINGO GAME

BACKGROUND OF THE INVENTION

This invention relates to bingo games and similar games of chance, and more particularly, to an apparatus and method for identifying winning cards in the course of play without intervention from the player holding the winning card.

Bingo is a game of chance played with game cards imprinted with a pattern of symbols. A game operator draws symbols and the winning card or cards are those cards which first produce a predetermined pattern of matches between the card symbols and the drawn symbols. Bingo may also be referred to as lotto, although this is to be distinguished from lottery games in which players simply choose their own numbers or symbols and winners are determined on the basis of matches between the player chosen numbers or symbols and randomly drawn numbers or symbols.

In a bingo game sequence, a game conductor or operator oversees the sale of preprinted game cards to game players. Each game card comprises a sheet of material having a preprinted pattern of card symbols which are often, but not necessarily, arabic numerals, printed on the face of the material. Often, the pattern forms a grid and traditionally a five-by-five grid of squares commonly known as a card face. The card symbols are selected from a pool of symbols, for example, the numbers 1 through 75. Traditionally, the first grid column of five squares may include any combination of the numbers 1 through 15, the second column any combination of the numbers 16 through 30, and so forth, with the center of the five-by-five grid commonly comprising a free square. In this example of a five-by-five grid-type game card, there are more than $1\times10^{17}$ possible combinations of card faces. Each number or other symbol printed on the card appears only once on that particular card. The symbols comprising the pool of symbols are printed on balls or other tokens which are randomly drawn in the game sequence by the game operator or conductor.

The game operator starts the bingo game by announcing a pattern on the game card which the player must have in order to win. The pattern must be produced by matches between the printed card symbols and the symbols drawn randomly by the game operator. The winning card or cards are those which first contain the predetermined pattern of matches. The predetermined pattern may be a row, column, diagonal, complex pattern such as a combination of such shapes, for example an H shape, or any other recognizable pattern including a totally matched card.

As the game operator draws or otherwise randomly produces symbols from the pool of symbols, they announce the drawn symbol to the players who have game cards for that sequence. The players are commonly located in a room or hall which has facilities including chairs and desks from which players may monitor their cards for matches. Each player is responsible for monitoring their card or cards and marking, or otherwise keeping track of each match between a symbol drawn by the game operator and a symbol printed on the card. The first player to produce matches in the predetermined pattern on a card announces to the operator and is the winner or a winner for that game sequence.

Problems arise in the play of bingo games due to the dependence upon the players for monitoring their game cards and announcing when a winner is produced. Players lose their chance to win if they fail to recognize that they have a winning pattern on a card before the next symbol is drawn. Thus, the game must be played fairly slowly in order allow sufficient time for players to check their card or cards. Also, the time allowed by the game operator for checking cards often does not account for any physical disability or handicap which a player may have which would cause the player to monitor their cards and announce more slowly than other players. Other than fairness to players with disabilities, a host of other issues arise, such as the size of numbers on the card face, the size of the card itself, and the number of game cards which one person is allowed to play in a single game sequence, for example. Bingo card producers produce cards in lots or series with a certain number of cards or card faces, commonly referred to as a bingo series. For example, a bingo series may include 9,000 faces or separate five-by-five grids. Each card face represents a unique permutation in that series. Also, bingo cards are commonly produced with a unique card identifier such as a serial number printed thereon. A card identifier may also be encoded in a bar code printed on the card or in some other code such as a magnetic code placed on the card. The card identifier or serial number may be used to identify the card face or arrangements of symbols printed on the card.

Card identifiers and card faces for a series of game cards are commonly also distributed in electronic format, along with the cards. The electronic information has been used to produce a certain level of automation in the play of bingo games in terms of verifying winning cards. In these verifying systems, the game is played the same way as purely manual games. However, as the game is played, the game operator inputs into a verifying computer or processor the winning pattern required for that game and each of the numbers as they are drawn by the game operator. When a player announces that they have a winning card, the player gives the card to the game operator and the operator inputs the winning card serial number or other identifier into the verifying computer. Software associated with the computer causes the system to access the card series database to verify that the card actually includes the winning pattern of matches.

U.S. Pat. No. 4,909,516, Kolinsky discloses an automated card game system which creates randomly numbered game cards and stores all cards in computer memory. As the game is played, the computer system plays each card, tracking every match. By tracking every match for each card in play, the system may alert the players and game operator when a winner is produced. Although the system disclosed in the Kolinsky Patent in theory eliminates the reliance on the game players, the system limits the types of games which may be played, and also requires significant processing power. Also, because the Kolinsky system produces its own randomly generated card faces, the system raises security and accountability problems.

SUMMARY OF THE INVENTION

It is an object of the invention to provide a bingo game monitoring and registering apparatus and method which overcomes the above-described problems and others associated with such games. More particularly, it is an object of the invention to provide an apparatus and method which provides flexible and secure real time monitoring and registering of a bingo game to eliminate any reliance on the game players for determining when a card represents a winning card.

In order to accomplish these objects, an apparatus according to the invention includes an arrangement for comparing each symbol drawn by the game operator with the potential winning card symbol combinations associated with all game cards issued in the particular game sequence. The apparatus automatically locates matches between the relevant card symbols for the issued cards and the drawn symbols. Also, the apparatus automatically determines if any issued card includes matches in the predetermined pattern, thereby representing a winning card. The comparison is done after each number is drawn or otherwise randomly produced by the game operator. The apparatus does not require any intervention on the part of any of the players in order to discover which card is a winning card for the game sequence and does not limit the types of games which may be played.

The apparatus according to the invention includes game card identifier input means, as well as card face storage means and means for storing symbols drawn by the game operator. The apparatus further includes winning pattern comparing means and display means for displaying the identifier of the winning card or cards.

The game card identifier input means comprises a device for entering into the monitoring and registering apparatus a unique card identifier associated with each card which is issued in a particular game sequence. The card face storage means stores the card identifier and the arrangement of card symbols printed on each card which may be issued in the game sequence, while the drawn symbol storage means stores each symbol drawn by the game operator during the game sequence. Both the card face storage means and the drawn symbol storage means preferably comprise mass storage associated with a suitable computer.

The winning pattern comparing means comprises operational software instructions which cause the computer processor to compare the potential winning symbol combination or win vector of each card issued in the game sequence with each symbol drawn b:y the game operator to determine if the drawn symbol matches any of the symbols in the potential winning combinations or win vectors associated with the cards issued in the game sequence. The comparison operation is performed for each drawn symbol immediately after it is drawn. By determining each match in a potential winning combination of each game card issued in the particular game sequence after each symbol is drawn by the game operator, the winning pattern comparing means is able to quickly determine or discover the winning card or cards and the card identifier associated therewith. Furthermore, the determination is made without any intervention by the player holding the winning card. Once the winning pattern comparing means discovers the winning card, the display means included in the monitoring and registering apparatus displays the card identifier associated with the winning card or cards to the game operator and preferably also displays the card identifier and face of the winning card or cards to the players.

The method according to the invention includes the steps of storing in computer memory the card symbol arrangement and a card identifier for each card which may be issued in a game sequence, as well as producing and storing in computer memory each potential winning symbol combination or win vector based upon the type of game pattern being played. After each symbol is drawn by the game operator, the method includes the step of comparing the symbol drawn by the game operator with the stored potential winning card symbol combinations or win vectors to determine if any of the cards issued in the game sequence has a card symbol in a potential winning combination which matches the drawn symbol. The comparison also determines if any card issued in the game sequence includes card symbols which are matched by drawn symbols to produce the predetermined pattern and thereby represents a winning card. Once the comparison of drawn symbols to stored potential winning card symbol combinations shows a winning card, the method concludes with the step of displaying the identifier and card face for each winning card.

These and other objects, advantages, and features of the invention will be apparent from the following description of the preferred embodiments, considered along with the accompanying drawings.

BRIEF DESCRIPTION OF THE DRAWINGS

FIG. 4 is a representation of a game wins table embodying the principles of the invention.

DESCRIPTION OF THE PREFERRED EMBODIMENTS

Figure 1:
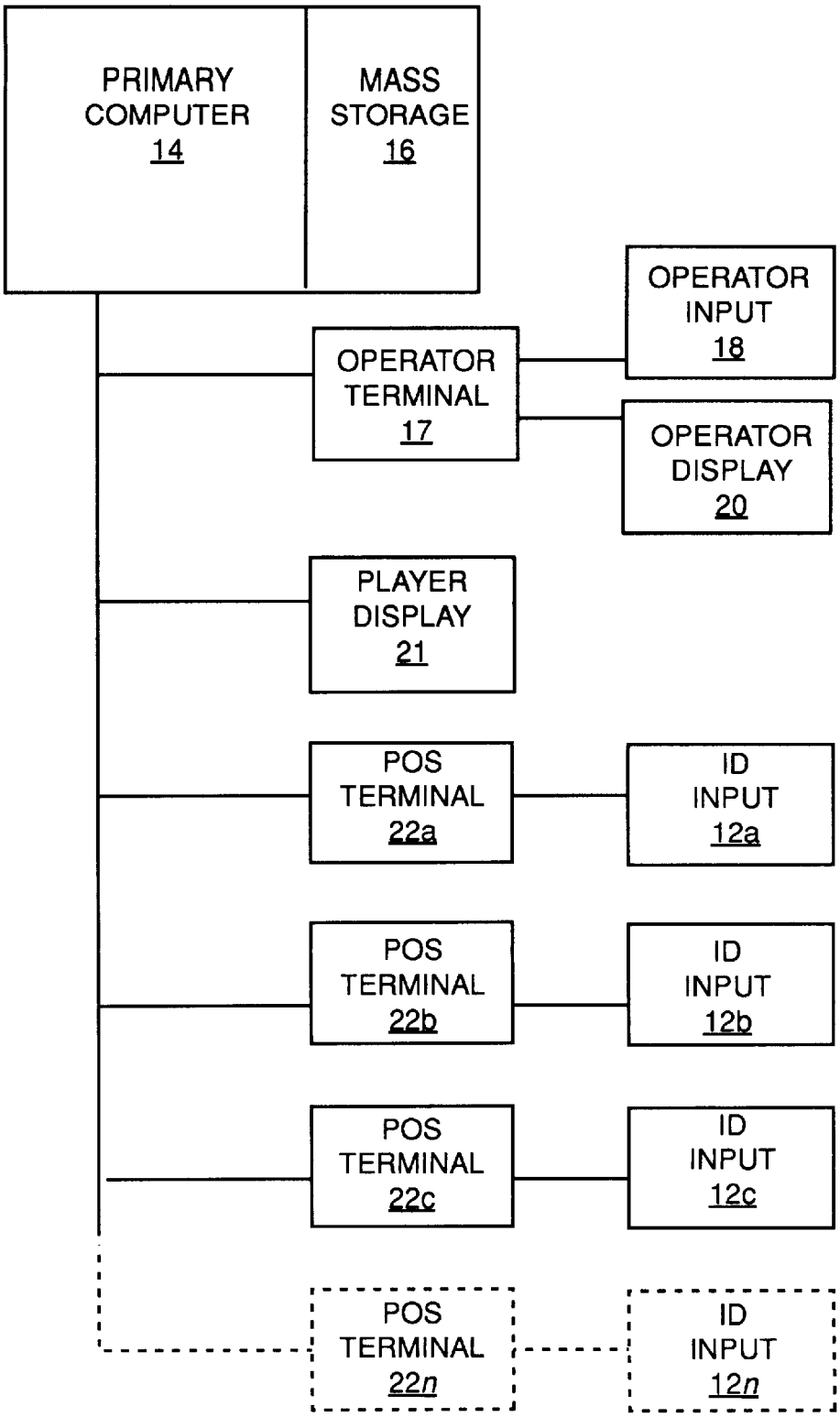
FIG. 1 is a diagrammatic representation of a bingo game monitoring and registering apparatus embodying the principles of the invention.

FIG. 1 illustrates one form of monitoring and registering apparatus 10 embodying the principles of the invention. The apparatus 10 includes at least one and preferably a plurality of card identifier input devices 12*a, b, c, . . . n*, each connected to a primary computer or server 14. The primary computer 14 has associated with it mass storage 16 for storing operational software and data. An operator input 18 and an operator display 20 are associated with an operator terminal 17 which is in turn connected for communication with the primary computer 14. The system also preferably includes a player display system shown at reference numeral 21.

In the preferred form of the invention illustrated in FIG. 1, each card identifier input 12*a, b, c, . . . n* is associated with a point of sale terminal or computer 22*a, b, c, . . . n*, which is connected via a suitable local area network connection to the primary computer 14. A given installation of the apparatus 10 may include practically any number of card identifier input devices 12*a, b, c, . . . n* and associated point of sale terminals 22*a, b, c, . . . n* connected in any suitable way to communicate with the primary computer 14 as discussed below. One important aspect of the apparatus 10 is that the card identifier input devices 12*a, b, c, . . . n* may or may not be in the same physical location as the primary computer 14. Unlike most prior bingo-type game operations, games monitored and registered with the apparatus 10 may have sales of game cards at remote locations and the point of sale terminals and associated card identifier input devices at these remote locations may be connected to the primary computer 14 over a wide area network.

The card identifier input devices 12*a, b, c, . . . n* comprise means for producing a card identifier input in a format usable by the primary computer 14. For example, the identifier input devices 12*a, b, c, . . . n* may simply be keyboards which a sales attendant uses to enter a card identifier such as a serial number. Preferably, however, the card identifier, input devices 12*a, b, c, . . . n* each comprise a suitable code reader for reading a code printed or otherwise affixed to each game card. Each card identifier input device thus may comprise a bar code reader for reading a card identifier printed on a game card in the form of a bar code.

Alternatively, each card identifier input means may comprise a magnetic reader device capable of reading a magnetic strip affixed to a game card.

The primary computer 14 is operated by a game operator and programmed to receive the card identifiers from the card identifier input devices 12*a, b, c, . . . n*. The primary computer 14 also includes operational software enabling it to receive and store identifiers for game cards available to be distributed or used in a game sequence, along with the card symbols on each card and the position of each symbol on the card. Those skilled in the art will appreciate that in a network of computers such as that illustrated in FIG. 1, the processing required in the operation of the apparatus may be distributed over the network and implemented in a number of different fashions. Thus, the processing steps discussed herein in connection with the primary computer 14, may in fact be distributed over the network and not necessarily performed by any single processor.

Figure 2:
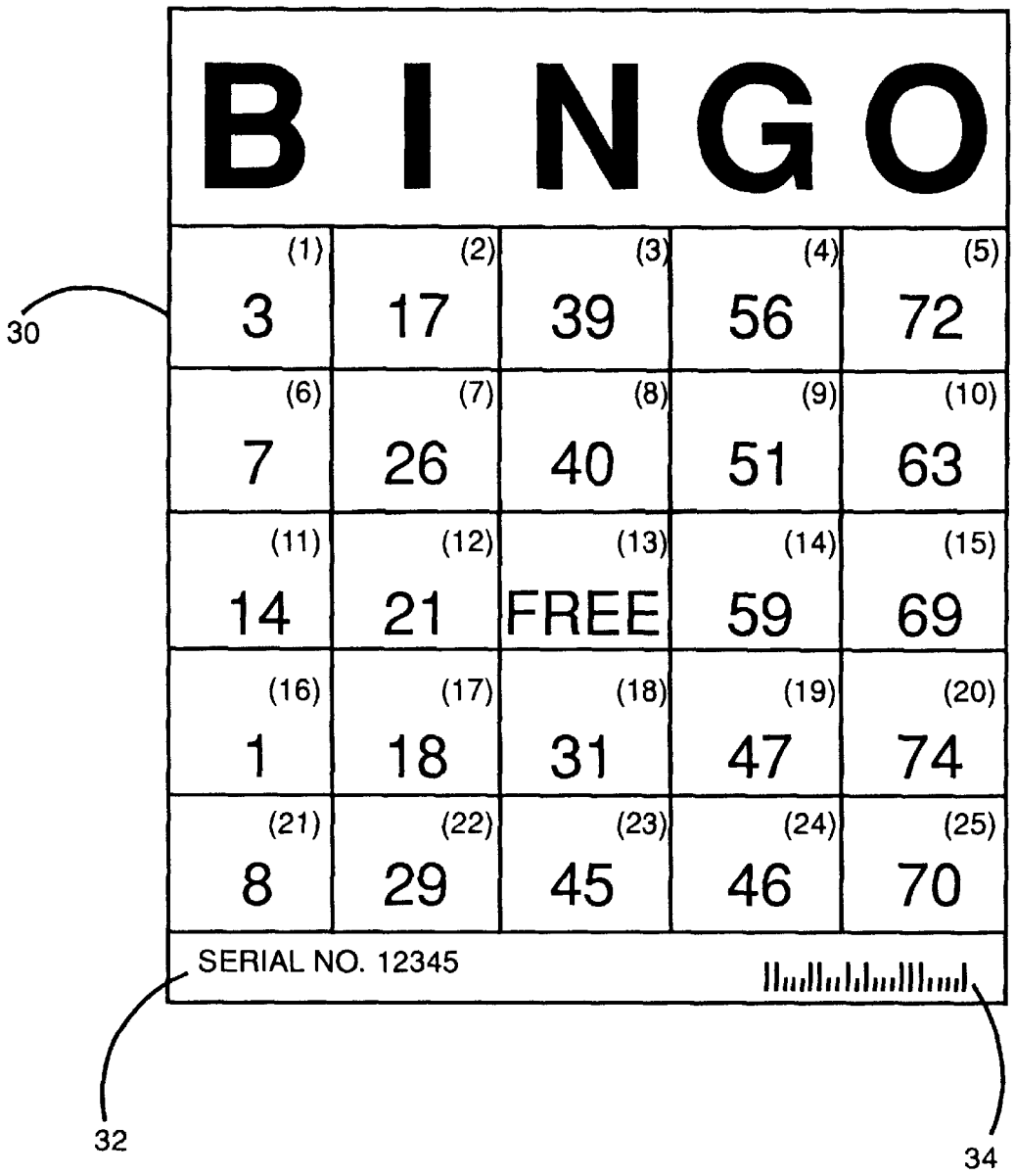
FIG. 2 is a representation of a prior art game card which may be used in conjunction with the apparatus and method of the invention.

Referring to FIG. 2, the bingo game monitored and registered by the apparatus 10 requires game cards 30 which are issued in a given game sequence. FIG. 2 illustrates a standard bingo game card 30 comprising a five-by-five grid of squares. The first column in the grid may include any combination of numbers from 1 through 15, for example, whereas the second column may include any combination of numbers from 16 through 30, for example. Although numbers are commonly used as the card symbols, it is possible to use any other type of symbol. The numbers shown in parentheses in FIG. 2 do not actually appear on the card, but indicate a position of a particular square within the grid. For example, position (1) on the card 30 is printed with the number 3 while position (8) is printed with the number 40. The illustrated card is printed with an identifier comprising an identifying number or serial number 32 and the identifier is also printed in the form of a bar code 34 which allows the serial number to be entered into the apparatus 10 using a bar code reader.

The card identifier identifies the card and the card face or arrangement of symbols printed on the card. Each card identifier or serial number and the card face must be stored in a suitable electronic format and made available to the primary computer 14. Commonly, such files are available for a particular game card series in the form of an electronic or computer storage file referred to as a permutation table. The permutation table typically includes for each card the card identifier or serial number for each card and each number printed on the card in a sequence which indicates the position of each printed number. For example, the permutation table may include an entry for each card which includes in a first memory location the card identifier or serial number. The number printed in the (1) position on the card may be in a second memory location; the number printed in the (2) position on the card may be in a third memory location; and so forth. The number printed in any position on the card may thus be found in this format by recalling the memory location associated with the position.

Figure 3:
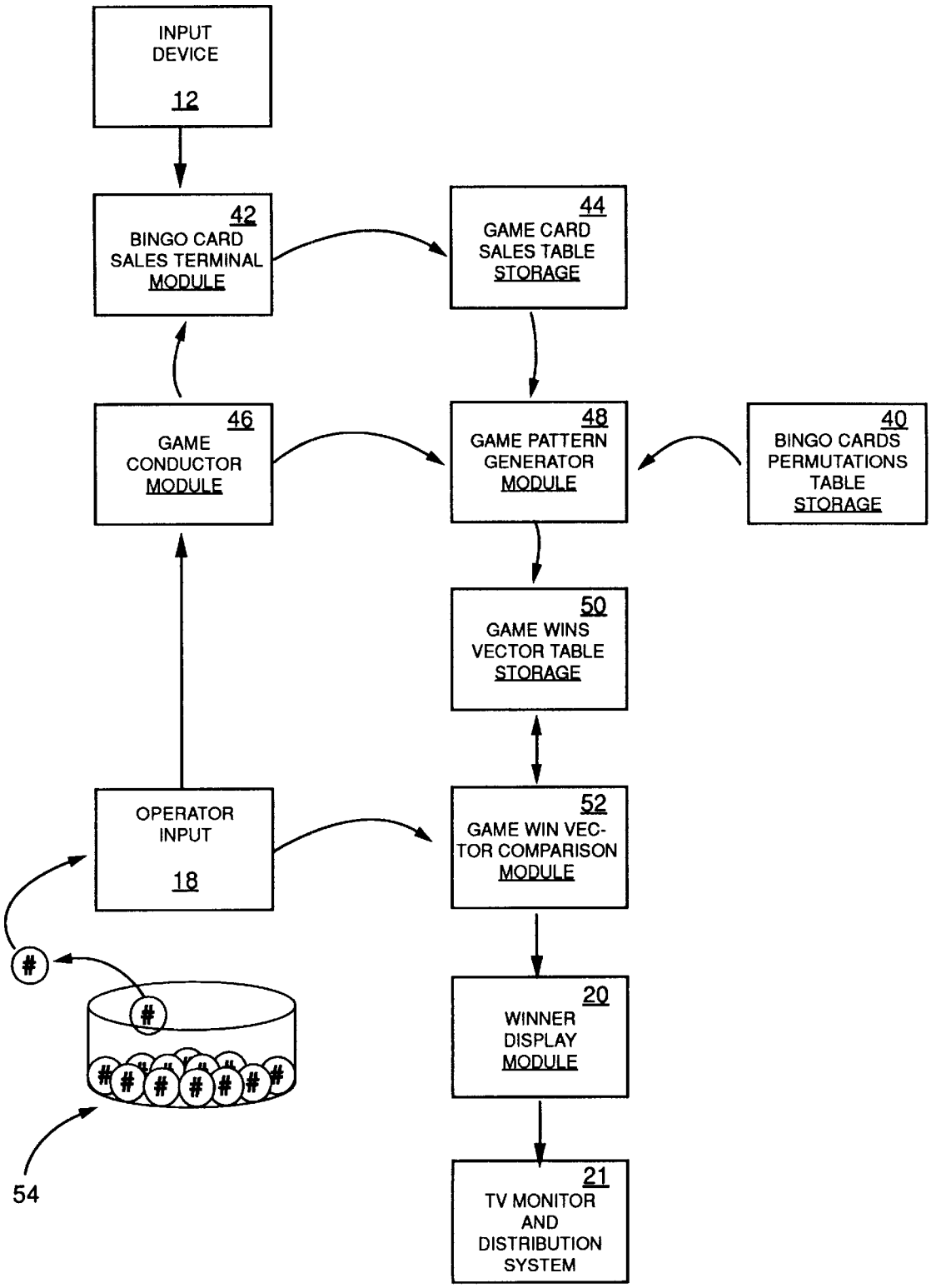
FIG. 3 is a block diagram of the process flow according to the invention.

FIG. 3 illustrates the process under which the apparatus 10 (FIG. 1) operates to provide the real time monitoring and registering according to the invention. The apparatus 10 is first initialized for each game sequence. A card permutation table 40 is stored preferably in the mass storage 16 associated with the primary computer 14 or otherwise made available to the primary computer shown in FIG. 1. The card permutation table 40 comprises the identifier for each card 30 available to be sold in the game sequence and the symbols printed on each particular card each associated in some manner with its position on the care. Also, preferably prior to any game card sales, the game operator announces, and sets up or enters through input 18, the type of game, that is, the predetermined pattern which will win the particular game sequence. The pattern may be a line across the card, or a diagonal, or any other combinations which will produce a recognizable pattern. An important aspect of the invention is that it is not limited in any way by the type of pattern which may be played. The pattern may be made up of one or more complete columns, rows or diagonals or any portion of a complete column, row or diagonal.

The preferred system 10 includes security and administrative functions which ensure that the games are played in a strictly controlled manner. For example, the system may include an organization time table and associated operational software which specifies which organization may utilize the system to conduct games and at what times. The system may also include a session control table and associated operational software which monitors all activities of a session and ends the session at a scheduled time. Also, rather than inputting the type of game immediately before each game sequence, a series of game types may be stored for a series of game sequences planned over a period of time.

Once the apparatus 10 is initialized for a game sequence, cards 30 are sold or otherwise issued to game players at the point of sale computers or terminals 22*a, b, c, . . . n*. For each card 30 issued in the game sequence, the card identifier for the issued card is entered into the apparatus 10 through one of the card identifier input devices 12*a, b, c, . . . n*.

In the preferred form of the invention, a sales module 42 comprising suitable software loaded on the network, preferably the point of sale computers 22*a, b, c, . . n*, controls the game card identifier input. The sales module software 42 operates to receive the card identifiers through the input devices 12*a, b, c, . . . n* and checks or queries the card permutation table 40 to verify that the identifier which has been entered is a valid identifier. If the identifier is not valid, then the sales module software 42 causes the particular point of sale computer 22 to produce a suitable signal to the point of sale operator so that the game operator can replace the card. If the card identifier is valid, the sales module software 42 causes the point of sale computer 22 to query a game card sales table 44 stored in the mass storage associated with computer 14 to determine if the identifier is already recorded in the table. The game card sales table 44 comprises a computer file or database table having at least a list of all identifiers previously sold for that game sequence. If the card identifier is not already recorded in the game card sales table, the sales module software 42 causes the computer 14 (FIG. 1) to enter the card identifier in the game card sales table 44. In the preferred form of the invention, the game card sales table comprises a file containing each card identifier, and for each card a unique game card number, and win/no win element which is used after a game is played to indicate whether the card is a winning card for the particular game for archival purposes.

After a period of time for sales, the game operator closes sales of game cards for that particular game sequence. To close sales, the game operator produces a closed sales input through the operator input 18 and this closed sales input causes operator module software 46 associated with the computer 14 to issue a closed game sale signal to all point of sale terminals 22 thereby preventing additional game card identifiers from being entered.

In the preferred form of the invention, the closed sales input also actuates a game pattern generator or winning card symbol combination generating means 48 which may be implemented through operational software operating on the primary computer 14. The game pattern generator 48 uses the predetermined pattern or game type previously entered by the game operator and the information from the game card sales table 44 and permutation table 40 to produce a series of potential winning symbol combinations or win vectors. Each combination or win vector represents a number of symbols on one of the game cards 30 issued for the game sequence which, if matched by symbols drawn by the game operator will produce a winning pattern. As shown in FIG. 4, each potential winning symbol combination or win vector is stored in a game wins table 50 along with the card identifier and/or game card number of the card having the symbol pattern printed thereon.

FIG. 4 shows a small portion of a game wins table 50 embodying the principles of the invention. The type of game to produce this table is a game in which any complete diagonal pattern is a winner. The entries in the table 50 are for the example card shown in FIG. 2, which is shown as Game Card No. 1. The numbers required to produce the winning pattern are either 3, 26, 47, 70, representing vector No. 1, or 72, 51, 18, 8, representing vector No. 2. If the pattern for the game had been the inner square, Card No. 1 would. have only a single vector in the table and the required numbers to produce the winning combination or win vector would be 26, 40, 51, 21, 59, 18, 31, and 47 for the sample card shown in FIG. 2.

The game pattern generator 48 includes operational software which stores the required positions on a game card to produce a particular pattern. To produce the game wins table 50, game pattern generator 48 retrieves from the permutation table 40 the numbers or other symbols associated with the indicated position on the game card. For example, the stored instruction for the game in which the inner square is the winning pattern, causes the processor to retrieve from the permutation table 40, the number associated with the positions (7), (8), (9), (12), (14), (17), (18) and (19) for each game card sold or in play for the particular game sequence. The retrieved numbers or symbols are then written to the game wins table 50 as a vector of the required numbers.

Once the game wins table 50 is produced, the game operator may begin play, drawing symbols randomly as in any bingo operation. A common random drawing device 54 comprises a bin or other suitable container housing a number of balls or other devices having symbols printed thereon. Alternatively, the random symbols may be electronically generated.

As each symbol is drawn by the game operator, the operator enters the drawn symbol through a suitable input 18, such as the keyboard, and each drawn symbol is stored in memory associated with the primary computer 14 (FIG. 1). Stored winning pattern comparing means 52 implemented in software on the primary computer 14 operates to receive the drawn symbol entered by the game operator and to query the game wins table 50 to determine all of the matches between the drawn symbol and symbols in the series of potential winning combinations or vectors stored in the game wins table 50. The comparing means 52 also increments a counter for each match with a combination in the game win table 50. The process of the game operator drawing symbols and entering symbols into the apparatus 10 continues until the comparing means 52 determines that the number of matches for a combination or win vector equals the total number of symbols in such combination. This condition indicates that the combination is a winning combination. For example, in FIG. 4 a winning card is indicated when the total matches for the vector equals four.

Once the winning combination or vector is identified, the comparing means 52 produces a signal to the game operator indicating a winning card and displaying on the operator display 20 the card identifier of the winning card, or cards if more than one card wins on the draw. The game operator may then announce the winning card identifier by any suitable means, or the system may automatically display the winning card identifier and card face on player display 21, which may be one or more large screen displays suitable for displaying information to a large audience of game players or individual display means on a network of user terminals. Finally, in the preferred form of the invention, all information collected in the course of the game sequence, including drawn symbols, the game wins table 50, and game card sales table 44 are stored in a storage device 16 (FIG. 1), for report generating, accounting, and archival purposes, and the system is reset or initialized for a new game sequence.

The apparatus and method for monitoring and registering a bingo game according to the invention has a number of advantages over previous systems. The apparatus and method do not require player intervention in order to determine when a winning card is produced. The system itself determines in real time when a card has won. By "real time", Lit is meant that the determination occurs immediately after each symbol is drawn by the game operator with no delay for verification. Thus, the apparatus and method makes all players equal regardless of their respective physical abilities or disabilities. Additionally, since the game does not require input from the players, the game may be played at a much quicker pace. The apparatus and method also opens up the possibility of remote play since it does not require that players be present to announce when they have a winning card. Also, by using the game wins table 50, which includes only potential winning symbol combinations or win vectors, the system searches for only relevant matches thus reducing processing time significantly. Also, the use of win vectors enables the system to process any desired pattern as a winning pattern.

Those skilled in the art will readily appreciate that an apparatus embodying the principles of the invention may be implemented in a number of different ways. Although the apparatus is illustrated as being implemented through software running on a general purpose computer, a special purpose processor with hardwired logic may be used within the scope of the invention and is to be considered an equivalent of the illustrated general purpose computers. Furthermore, any network communication system may be used to provide the required communication between the card identifier input devices 12*a, b, c, . . . n* and the primary computer 14. The processing required of the system may be distributed in any suitable fashion over the network processors.

The above described preferred embodiments are intended to illustrate the principles of the invention, but not to limit the scope of the invention. Various other embodiments and modifications to these preferred embodiments may be made by those skilled in the art without departing from the scope of the following claims.

I claim:

1. An apparatus for monitoring and registering a bingo game played in a game sequence in which players are issued game cards each having card symbols formed thereon in a different pattern, and in which a game operator randomly draws symbols from a pool of symbols from which the card symbols formed on the game cards are selected, and wherein the winning card comprises that card which first produces a predetermined pattern of matches between the card symbols and the game operator drawn symbols, the apparatus comprising:

(a) a game card identifier input means for entering a unique card identifier associated with each card issued in a game sequence;

(b) card face storage means for storing the pattern of card symbols formed on each card issued in the game sequence and for storing the unique card identifier associated with each card issued in the game sequence;

(c) winning card symbol combination generating means associated with the card face storage means and the game card identifier input means, the winning card symbol combination generating means for producing and storing every potential winning symbol combination for each card issued in the game sequence, each potential winning symbol combination comprising a group of symbols which, if first matched by operator drawn symbols in the game sequence would make the respective card a winning card; and (d) winning pattern comparing means (i) for comparing each respective drawn symbol with the symbols contained in the potential winning symbol combinations to determine each match between the respective drawn symbol and a card symbol contained within one of said potential winning symbol combinations, and (ii) for retrieving the card identifier associated with the card having the potential winning symbol combination which is first matched by drawn symbols in the game sequence.

2. The apparatus of claim 1 wherein the game card identifier input means comprises a game card reader and the unique card identifier comprises a code located on the card, the code representing an identification number.

3. The apparatus of claim 2 further comprising a plurality of game card readers.

4. The apparatus of claim 3 wherein each card reader is associated with a sales terminal at which cards are sold for the game sequence.

5. The apparatus of claim 4 wherein the winning card symbol combination generating means and the winning pattern comparing means are each implemented on a computer and software therefore, and the computer is connected with each card reader and sales terminal via a computer network connection.

6. The apparatus of claim 1 wherein the card face storage means includes a database storing the card identifier for each card available to be issued over a series of game sequences and the pattern of card symbols formed on each said card.

7. The apparatus of claim 1 further comprising an operator input by which a game operator defines the predetermined pattern required of the winning card.

8. A method of monitoring and registering a bingo game played in a game sequence in which players obtain game cards each having card symbols formed thereon in a different pattern, and in which a game operator randomly draws symbols from a pool of symbols from which the card symbols are selected, and wherein the winning card is that card which first produces a predetermined pattern of matches between the card symbols and the operator drawn symbols, the method comprising the steps of:

(a) storing in computer memory the card symbol pattern and a card identifier for each card issued in a game sequence;

(b) producing and storing every potential winning symbol combination for each card issued in the game sequence, each potential winning symbol combination comprising a group of symbols which, if first matched by operator drawn symbols in the game sequence, would make the respective card with which such combination is associated a winning card; and (c) after each symbol is drawn by the game operator, comparing the respective drawn symbol with the symbols contained in the potential winning symbol combinations to determine each match between the respective drawn symbol and a symbol contained in one of the potential winning symbol combinations, and to determine when all of the symbols in any of the potential winning symbol combinations have been matched in the game sequence.

9. The method of claim 8 further comprising the step of:

(a) retrieving the card identifier for the card having the potential winning symbol combination which is first completely matched by symbols drawn in the game sequence.

10. The method of claim 8 wherein the step of storing a card identifier for each card issued in a game sequence includes entering a code representing the card identifier.

11. The method of claim 10 wherein the step of entering the code representing the card identifier comprises reading a bar code with a bar code reader, the bar code being printed on the particular card.

12. The method claim 10 wherein the step of entering the code representing the card identifier for a plurality of cards issued in the game sequence is performed at a plurality of terminals, and further including the step of transferring the card identifier from each terminal to a primary processor.

13. The method of claim 8 wherein the step of storing the card symbol pattern and the card identifier for each card issued in the game sequence further comprises storing the card identifier and pattern of card symbols for each card available to be issued over a series of game sequences.

14. The method of claim 8 further comprising the step of inputting the predetermined pattern for a winning card for the game sequence from a game operator's input terminal.

15. A program product for operating on a computer, the program product for monitoring and registering a bingo game played in a game sequence in which players are issued game cards each having card symbols formed thereon in a different pattern, and in which a game operator randomly draws symbols from a pool of symbols from which the card symbols formed on the game cards are selected, and wherein the winning card comprises that card which first produces a predetermined pattern of matches between the card symbols and the game operator drawn symbols, the program product comprising:

(a) a computer-readable storage medium;

(b) a game card identifier receiving means stored on the medium for enabling the computer to receive a unique card identifier associated with each card issued in a game sequence;

(c) winning card symbol combination generating means stored on the medium for enabling the computer to (i) access a card face storage means which stores the pattern of card symbols printed on each card issued in the game sequence and the unique card identifier associated with each such card, and (ii) produce and store every potential winning symbol combination for each card issued in the game sequence, each potential winning symbol combination comprising a group of symbols which, if first matched by operator drawn symbols in the game sequence would make the respective card a winning card; and (d) winning pattern comparing means stored on the medium (i) for enabling the computer to compare each respective drawn symbol with the symbols contained in the potential winning symbol combinations to determine each match between the respective drawn symbol and a card symbol contained within one of said potential winning symbol combinations, and (ii) for enabling the computer to retrieve the card identifier associated with the card having the potential winning symbol combination which is first matched by drawn symbols in the game sequence.

16. The program product of claim 15 further comprising pattern definition means stored on the medium for enabling the computer to receive an operator input which defines the predetermined pattern required of the winning card.

* * * * *